US009591424B2

(12) United States Patent
Koppens et al.

(10) Patent No.: US 9,591,424 B2
(45) Date of Patent: Mar. 7, 2017

(54) GENERATING AN OUTPUT SIGNAL BY SEND EFFECT PROCESSING

(75) Inventors: Jeroen Gerardus Henricus Koppens, Eindhoven (NL); Erik Gosuinus Petrus Schuijers, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 883 days.

(21) Appl. No.: 13/140,476

(22) PCT Filed: Dec. 16, 2009

(86) PCT No.: PCT/IB2009/055779

§ 371 (c)(1),
(2), (4) Date: Jun. 22, 2011

(87) PCT Pub. No.: WO2010/073187

PCT Pub. Date: Jul. 1, 2010

(65) Prior Publication Data

US 2011/0249758 A1 Oct. 13, 2011

(30) Foreign Application Priority Data

Dec. 22, 2008 (EP) ..... 08172499

(51) Int. Cl.
*H04S 3/00* (2006.01)

(52) U.S. Cl.
CPC ..... *H04S 3/002* (2013.01); *H04S 2400/01* (2013.01); *H04S 2420/01* (2013.01); *H04S 2420/03* (2013.01)

(58) Field of Classification Search
CPC .. H04S 3/002; H04S 2420/03; H04S 2400/01; H04S 2420/01
See application file for complete search history.

(56) References Cited

U.S. PATENT DOCUMENTS 7,782,235 B1 * 8/2010 Velazquez ..... H03M 1/1004 341/118
2008/0130904 A1 * 6/2008 Faller ..... 381/17
2008/0189117 A1 * 8/2008 Oh et al. ..... 704/500

FOREIGN PATENT DOCUMENTS

JP 2011529650 A 12/2011
WO 2007110103 A1 10/2007
(Continued)

OTHER PUBLICATIONS

Breebaart, J.: "Analysis and Synthesis of Binaural Parameters for Efficient 3D Audio Rendering in MPEG Surround";IEEE International Conference on Multimedia and Expo, Beijing, China, Jul. 2007, 5 Page Document.

(Continued)

*Primary Examiner* — Chikaodili E Anyikire
*Assistant Examiner* — Nam Pham

(57) ABSTRACT

An output signal is generated from an input signal by applying a send effect processing to the input signal. The input signal comprises a weighted sum of component signals. Dependencies between the weighted component signals are represented by parameters. In accordance with the present invention, the output signal is generated in dependence of the parameters to compensate for an unequal weighting of component signals comprised in the input signal. Due to this compensation the strength of the send effect corresponding to the separate component signals is (nearly) proportional to the strength of each of the component signals, which results in more realistic surround experience.

19 Claims, 7 Drawing Sheets

(56) References Cited

FOREIGN PATENT DOCUMENTS

| | | | |
|---|---|---|---|
| WO | 2007140809 | A1 | 12/2007 |
| WO | 2010012478 | A2 | 2/2010 |

OTHER PUBLICATIONS

Breebaart et al: "Multi-Channel Goes Mobile: MPEG Surround Binaural Rendering"; AES 29th International Conference, Seoul, Korea, Sep. 2006, pp. 1-13.

Paranjpe et al: "Time-Variant Orthogonal Matrix Feedback Delay Network Reverberator"; Audio Engineering Society Convention Paper 5381, Presented at the 110th Convention, May 12-15, 2001, Amsterdam, The Netherlands, 6 Page Document.

Engdegard et al:"Spatial Audio Object Coding (SAOC)—The Upcoming MPEG Standard on Parametric Object Based Audio Coding"; Audio Engineering Society Convention Paper, Presented at the 124th Convention, May 17-20, 2008, Amsterdam, The Netherlands,15 Page Document.

Gardner, W.:"Reverberation Algorithms"; Chapter 3 of "Applications of Digital Signal Processing to Audio and Acoustics"; Mark Kahrs and Karlheinz Brandenburg (Editors), Kluwer Publishers, Mar. 1998, pp. 85-131.

"DAFX: Digital Audio Effects"; Published by John Wiley & Sons, Ltd, 2002, Section 2.4 (pp. 55-59), Section 3.3.2 (pp. 69-71), Section 5.4 (pp. 128-132).

International Organization for Standardization, "WD on ISO/IEC 20013-2:200x, SAOC Text and Reference Software"; ISO/IEC JTC 1/SC 29/WG 11N9517, Shenzhen, China, Oct. 207, 80 Page Document.

ISO/IEC JTC 1/SC 29, ISO/IEC FDIS 23003-1-1:2006(E), ISO/IEC JTC 1 SC 29WG 11, "MPEG Surround"; Jul. 21, 2006, 289 Page Document.

TU-R BS.775:"Multichannel Stereophonic Sound System With and Without Accompanying Picture"; Geneva Switzerland 1994, 10 Page Document.

* cited by examiner

GENERATING AN OUTPUT SIGNAL BY SEND EFFECT PROCESSING

FIELD OF THE INVENTION

The invention relates to a method of and device for generating an output signal from an input signal by applying a send effect processing to the input signal, wherein the input signal comprises a weighted sum of component signals, wherein dependencies between the weighted component signals are represented by parameters. The invention also relates to a binaural decoder for generating an improved binaural output signal, and a computer program product.

BACKGROUND OF THE INVENTION

MPEG Surround is one of major advances in audio coding recently standardized by MPEG, see ISO/IEC 23003-1 MPEG Surround. MPEG Surround is a multi-channel audio coding tool that allows existing mono- and stereo-based coders to be extended to multi-channel. The MPEG Surround encoder typically creates a mono or stereo downmix from the multi-channel input signal, and derives spatial parameters from the multi-channel input signal. The downmix and spatial parameters are encoded in separate streams. However, the spatial parameters stream can be embedded in the downmix stream. The MPEG Surround decoder decodes the spatial parameters that are used to upmix the decoded downmix in order to obtain the multi-channel output signal. Since the spatial image of the multi-channel input signal is parameterized, MPEG Surround allows decoding the encoded stereo downmix onto other rendering devices, such as these comprising a reproduction on headphones. This particular mode of operation is referred to as the MPEG Surround binaural decoding process in which the spatial parameters are combined with the Head Related Transfer Function (HRTF) data (J. Breebaart, Analysis and Synthesis of Binaural Parameters for Efficient 3D Audio Rendering in MPEG Surround, ICME 07) to produce the so-called binaural output. In this mode a realistic surround experience can be provided using regular headphones. Traditionally HRTF data is typically described as a set of pairs of impulse responses going from each speaker to both ears.

When the MPEG Surround binaural decoder is operated in a Low Power (LP) mode it can be implemented in mobile devices. In this mode in an offline process the raw HRTF data has been converted to a parametric domain allowing processing using low computational complexity. However, a disadvantage of the LP mode is that the parametric HRTF data represents typically only an anechoic portion of the raw HRTF data, i.e. it only covers a part of complete time domain responses which is primarily associated to directional cues. In practice, this means that the binaural decoder output signal will contain directional information, but will not sound very natural since there is hardly any externalization, which is primarily associated with the echoic part of the HRTF data. In order to compensate this lack of externalization, the MPEG Surround standard allows a use of a reverberation, as prescribed in ISO/IEC 23003-1 MPEG Surround Annex D. In such case, the MPEG Surround binaural decoder is extended with parallel reverberation. The input stereo downmix is fed to the reverberation process. The output of this process is directly added to the MPEG Surround binaural output. With such a parallel reverberation signal that is typically omni-directional, i.e. independent of direction, the echoic part is created and thus a more realistic surround experience is created.

However subjective tests with a reverberation, which is a type of a so-called send effect, added to the binaural output signal do not show satisfactory performance. One of the prominent artifacts in such binaural output is that when the original multi-channel encoder content is primarily present in the center channel, the binaural output signal sounds too reverberant.

A similar disadvantage holds for other send effects such as e.g. chorus, vocal doubler, fuzz, space expander, etc.

SUMMARY OF THE INVENTION

It is an object of the present invention to provide an improved method of generating an output signal from an input signal by applying a send effect processing to the input signal, which results in an improved output signal offering for some of the send effects an improved surround experience. The invention is defined by the independent claims. The dependent claims define advantageous embodiments.

This object is achieved according to the present invention in a method of generating the output signal as stated above and characterized in that the output signal is generated in dependence of the parameters to compensate for an unequal weighting of component signals comprised in the input signal.

The send effects are applied to the input signal as a whole and not to the individual component signals. Therefore, it is especially advantageous, to compensate for the unequal weighting of the component signals in the input signal while applying a send effect. Due to this compensation the strength of the send effect corresponding to the separate component signals is (nearly) proportional to the strength of each of the component signals, and thus resulting in more realistic surround experience. The invention is explained for a reverberation effect as an example of the send effect.

Reverberation is typically used to simulate acoustic reflections and can therefore be used in conjunction with (anechoic) HRTF data to place virtual sound sources out of the listener's head, i.e. in order to create a perception of a distance. The input signal is a downmix of component signals (e.g. the 6 channels of a multichannel representation) that are weighted before downmixing.

Typically, the component signals corresponding to surround channels comprised in a multichannel signal are attenuated before downmixing. When MPEG Surround encoding is used, the component signal corresponding to the center channel is effectively amplified in a stereo downmix (sqrt(0.5) per channel amounts to sqrt(2) when summing left and right downmix channel). This unequal weighting of the component signals comprised in the input signal results in the reverberation effect that is stronger for the component corresponding to the center channel and weaker for the components corresponding to the surround channels since a parallel reverberation employs the reverberation directly on the unequally weighted downmix. However, such unequal weighting does not match with the directional rendering of the 5.1 channels by using HRTF parameters, which (at least conceptually) map the restored component signals to the binaural signal. Therefore, when these signals, i.e. directional rendered signal based on restored component signals and the output signal obtained by applying reverberation to the input signal are mixed the externalization might not be natural in that the reverberation effect strength is dependent on the predominant direction of the original multichannel content. The adverse effect of the unequal weighting is reduced by modifying the generation of the output signal resulting from applying reverberation effect or any other send effect to the input signal such that it is adaptive to compensate the unequal weighting of component signals comprised in the input signal. This adaptation makes use of the parameters which comprise dependencies between the weighted component signals. The individually weighted components or combinations of the weighted components contributing to the input signal are not available anymore, as the component signals have been summed up (downmixed) after the weighting. However, the parameters allow for estimation of their contributions based on the dependencies between the weighted component signals represented by the parameters. There are various ways the adaptation of the generation of the output signal can be made, which are discussed in the following embodiments.

In an embodiment, the input signal is decomposed into a plurality of intermediate signals, wherein each of the intermediate signals is scaled with a respective gain to compensate for the unequal weighting of component signals comprised in the input signal. Generating intermediate signals (or at least using the intermediate signals conceptually) is beneficial when information from multiple component signals can be combined into the intermediate signals. For example left and right channel signals of the input signal both contain information from the center channel, when the MPEG Surround standard is used in a stereo compatible fashion. In such a case the intermediate signal corresponding to a center channel can be constructed using both left and right signals of the input signal. Furthermore, when the multichannel signal comprises five channel signals, i.e. the center channel signal, a left front channel signal, a left surround channel signal, a right front channel signal, and a right surround channel signal, the left front channel signal and the left surround channel signal can be combined in the intermediate signal, as well as the right front channel signal and the right surround channel signal can also be combined in the intermediate signal.

In a further embodiment, the respective gain corresponding to the respective intermediate signal is calculated as a weighted sum of predetermined further gains, wherein the predetermined further gains are derived from weights used to create the input signal, wherein the predetermined further gains are weighted with respective weights that are derived from relative contributions of the weighted component signals to the respective intermediate signal. One can approximate the component signals from the intermediate signal. MPEG Surround prescribes, for example, that OTT (one-to-two) processing block is used to create two signals from a single signal using the inter-channel intensity difference (IID) parameters, or TTT (two-to-three) processing block is used to create three signals from two signals, using channel prediction parameters and/or IID parameters. The gains can be applied on the signals created using the OTT and/or TTT processing blocks and the resulting signals can be downmixed again (a single channel is required for the send effect after all). However, the upmix step, i.e. creating multiple intermediate signals from the input signal, can be omitted because the energy distribution related to intermediate signals is known. Thus the current embodiment offers an efficient way to apply the gains to the intermediate signals, without actual restoring of the individual component signals contributing to these intermediate signals.

In a further embodiment, the relative contribution of the weighted component signals to the respective intermediate signal is derived from an intensity difference between the weighted component signals contributing to the intermediate signal, wherein the intensity difference is derived from the parameters. The energy distribution among the weighted component signals is comprised in the inter-channel intensity differences, which in turn are comprised in the parameters accompanying the input signal.

In a further embodiment, the input signal is scaled with a gain calculated as a weighted sum of further gains, wherein the further gains are derived from the parameters corresponding to the weighted component signals, wherein the further gains are weighted with weights that are derived from relative contributions of the weighted component signals or combinations of the weighted component signals to the input signal. This offers an efficient way to apply a gain to the input signal, without the actual need for restoring of the weighted component signals or combinations of the weighted component signals. For the mono input signal this means that a single gain is applied to the input signal. For the stereo input signal this means that two individual gains are applied, each for one of the two channels comprised in the input signal.

In a further embodiment, the relative contribution of the weighted component signals or the combinations of the weighted component signals are derived from intensity differences between weighted component signals contributing to the input signal, wherein the intensity differences are derived from the parameters. Conceptually, as in one of the previous embodiments, one can restore the weighted component signals from the input signal using e.g. several OTT processing blocks cascaded and in parallel. The OTT processing blocks are energy preserving, thus the energy distribution of the weighted component signals in the input signal is calculated based on the intensity differences comprised in the parameters. This distribution is relative to the energy of the input signal, thus an OTT processing block distributes the energy of its input signal over two output channels. Applying gains to the individual component signals can therefore be effectuated by applying a single gain to the input signal.

In a further embodiment, generating the output signal comprises adapting send effect processing applied to the input signal, based on the parameters. One could adjust the effect itself to compensate the weighing of the components but this is often a suboptimal solution in terms of efficiency.

In a further embodiment, generating the output signal comprises adapting the output signal itself, wherein the output signal is scaled with a gain that is adjusted in dependence of parameters. When adapting the output signal of send effect processing that is effected by e.g. a large time interval of the input signal (as it is often the case for reverberation filters), the parameters corresponding to certain time intervals may be mixed in a signal dependent manner due to the temporal smearing. In such a case it is advantageous to adapt the gain over time in dependence of the parameters, as well as the effect and signal properties.

In a further embodiment, the input signal and the parameters are the downmix signal and the spatial parameters, respectively, in accordance with the MPEG Surround standard. For MPEG Surround, the component signals are formed by the channels of a multichannel source (e.g. 5.1 audio from a DVD, multichannel recording with a multichannel microphone), the spatial parameters describe relations between the channels or combinations (intermediate downmixes) of channels in a time- and frequency dependent manner.

According to another aspect of the invention there is provided a send effect device for generating an output signal from an input signal by applying a send effect processing to the input signal. It should be appreciated that the features, advantages, comments etc. described above are equally applicable to this aspect of the invention.

These and other aspects, features and advantages of the invention will be apparent from and elucidated with reference to the embodiment(s) described hereinafter.

DETAILED DESCRIPTION OF EMBODIMENTS OF THE PRESENT INVENTION

Figure 1:
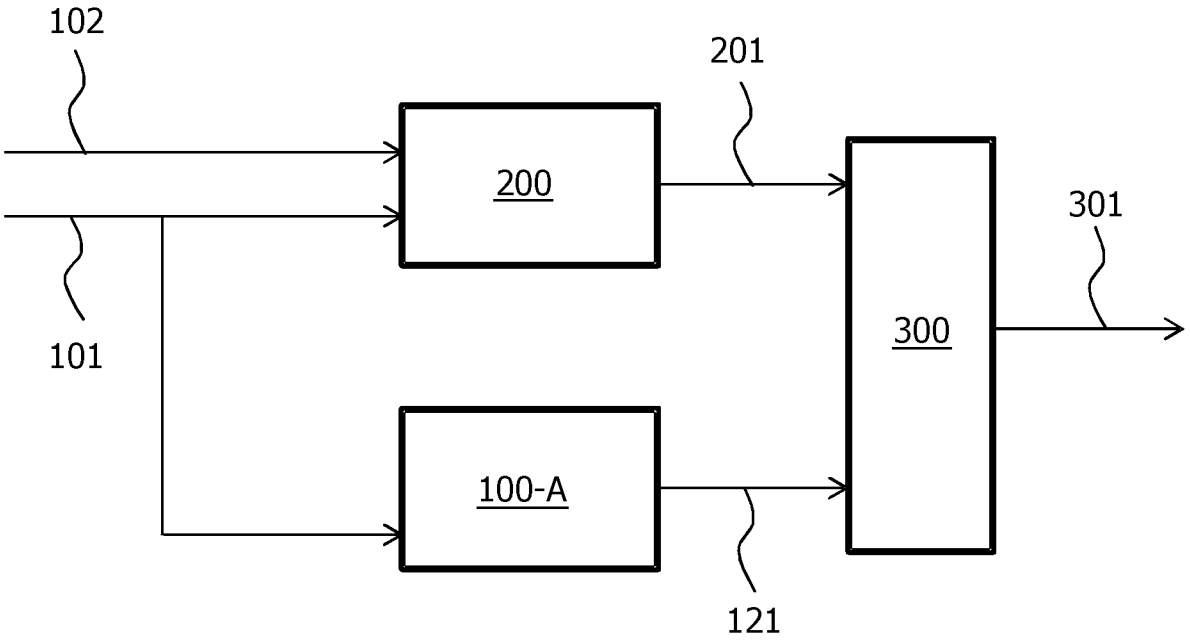
FIG. 1 shows an example architecture of a binaural renderer with a send effect processing block in parallel.

FIG. 1 shows an example of an architecture of a binaural renderer 200 with a send effect processing device 100-A in parallel. The input signal 101 comprising a weighted sum of component signals, together with parameters 102 comprising dependencies between the weighted component signals are fed to the binaural renderer 200. The binaural renderer 200 performs a processing of the input signal 101 and the parameters 102 to provide a binaural output 201 which is suitable for reproduction by headphones. One of the examples of the binaural renderer is MPEG Surround binaural decoding (ISO/IEC 23003-1, MPEG Surround). The input signal 101 is fed in parallel to the binaural renderer 200 to the send effect device 100-A, which applies send effect processing to the input signal 101 resulting in the output signal 121. The output signal 121 is added by the adding circuit 300 to the output of the binaural renderer. The output 301 of the adding circuit is provided to the headphones (not shown). There are various send effects such as e.g. reverberation, chorus, vocal doubler, fuzz, space expander, etc. Reverberation is one of the most popular send effects, which can be used to place virtual sound sources out of the listener's head, i.e. in order to create a perception of a distance. The creation of reverberated signal from the input signal is described in e.g. William G. Gardner, "Reverberation Algorithms" in "Applications of Digital Signal Processing to Audio and Acoustics". Mark Kahrs and Karlheinz Brandenburg (Editors), Kluwer, March 1998, or Shreyas A. Paranjpe, Time-variant Orthogonal Matrix Feedback Delay Network Reverberator, Audio Engineering Society 110th Convention Paper 5381, Amsterdam, The Netherlands, 12-15 May 2001. The reverberation effect is applied to the input signal as a whole.

The invention proposes a method of generating an output signal 121 by applying a send effect processing to the input signal 101, which compensates for an unequal weighing of component signals in the input signal 101 in dependence of the parameters 102. The component signals contributing to the input signal 101 are often unequally weighted. The send effect device 100 generates the output signal 121 in such a manner that the unequal weighting is compensated for in dependence of the parameters 102. Parameters 102 comprise dependencies between the weighted component signals. In particular, parameters 102 comprise information about relative contributions of individual weighted component signals to the input signal 101. The parameters 102 allow estimating of the weighted component signals relative to the input signal. Since the weights used to weigh the component signals are known, since they are prescribed by the MPEG Surround bit-stream and decoder, the component signals themselves can be estimated. This leads to efficient processing in order to compensate the unequal weighting of the component signals in the input signal 101.

Figure 2:
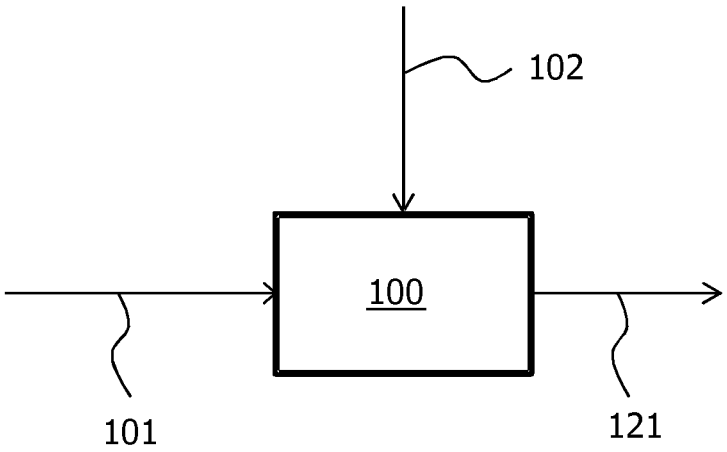
FIG. 2 shows an embodiment of a send effect device according to the invention.

FIG. 2 shows an embodiment of a send effect device according to the invention. The effect processing device 100 differs from the effect processing devices 100-A of the FIG. 1 in that it has the parameters 102 as additional input. Further, the effect processing device 100 of FIG. 2 implements the step of generating the output signal 121 that is adaptive to compensate for an unequal weighting of component signals comprised in the input signal in dependence of the parameters 102.

According to an embodiment, generating the output signal 121 comprises adapting the input signal 101. In this case the step of adapting the input signal precedes the step of applying a send effect processing.

Figure 3:
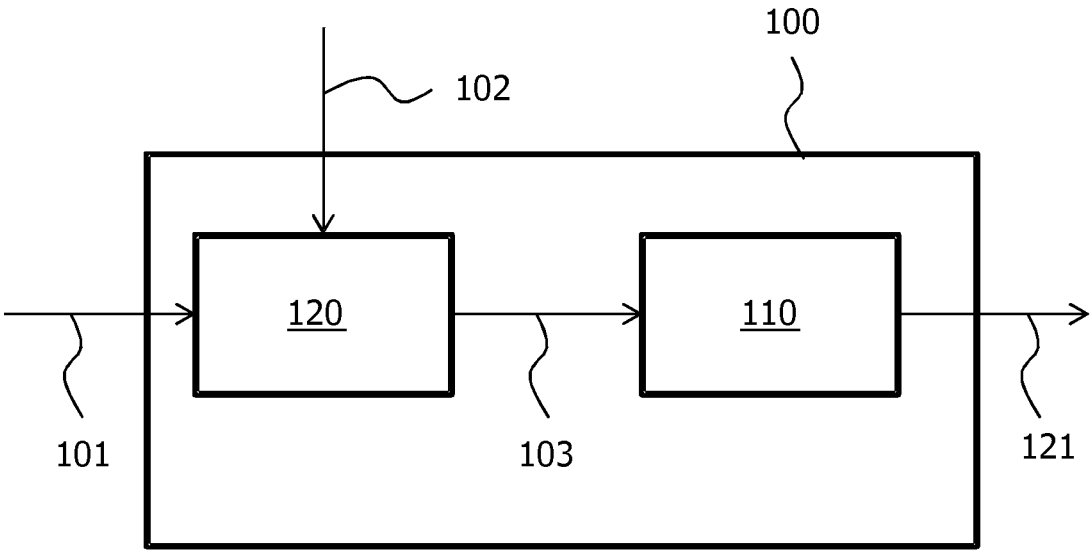
FIG. 3 shows an embodiment of a send effect device comprising adapting an input signal.

FIG. 3 shows an embodiment of a send effect device comprising adapting the input signal 101. The send effect device comprises two circuits, namely, an adapting circuit 120 that performs the step of adapting the input signal, and the send effect processing circuit 110 that performs the step of applying a send effect processing. The input signal 101 and the parameters 102 are fed into the circuit 120, whose output 103 is fed into the circuit 110. The output of the circuit 110 serves as an output signal 121. The input signal 101 can be either a mono signal or stereo signal.

Figure 4:
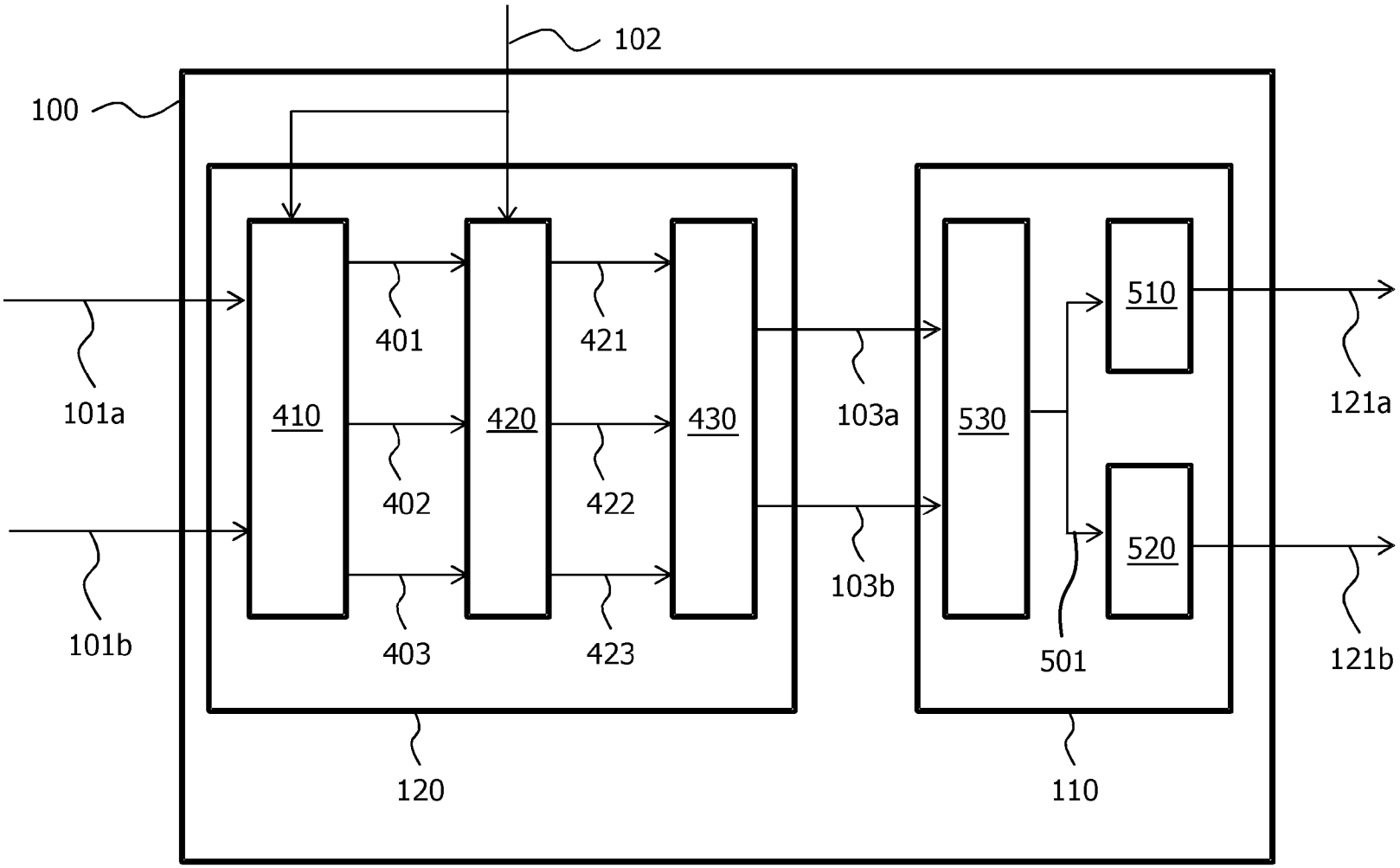
FIG. 4 shows an example architecture of the send effect device, wherein the input signal is decomposed into a plurality of intermediate signals, each of the intermediate signals being scaled with a respective gain.

FIG. 4 shows an example of an architecture of the send effect device 100, wherein the input signal 101 is decomposed into a plurality of intermediate signals 401, 402, and 403, each of the intermediate signals being scaled with a respective gain. The input signal 101 is a stereo signal and it comprises a left channel 101*a* of the input signal 101 and a right channel 101*b* of the input signal 101. The input signal is fed into a circuit 410, which performs upmixing of the input signal into three intermediate signals, which correspond to a left channel, a right channel, and a center channel. These three signals are referred to as a left intermediate signal, a right intermediate signal, and a center intermediate signal, respectively. The circuit 410 can be the Two-To-Three (TTT) module known from the MPEG Surround. For $l_{dmx}$ being the left channel of the input signal, $r_{dmx}$ being the right channel of the input signal, and $T_{umx}$ being the matrix representing the decoder TTT module multiplied by the artistic downmix inversion and/or matrix compatibility inversion and/or 3D inversion matrix (respective subclauses 6.5.2.3, 6.5.2.4 and 6.11.5 of MPEG Surround specification):

$$T_{umx} = \begin{bmatrix} c_{11} & c_{12} \\ c_{21} & c_{22} \\ c_{31} & c_{32} \end{bmatrix},$$

with $c_{ij}$ calculated from the MPEG Surround parameters and potentially HRTF data, the output of the circuit 410 is a result of the matrix multiplication:

$$T_{umx} \cdot \begin{bmatrix} l_{dmx} \\ r_{dmx} \end{bmatrix}.$$

Figure 5:
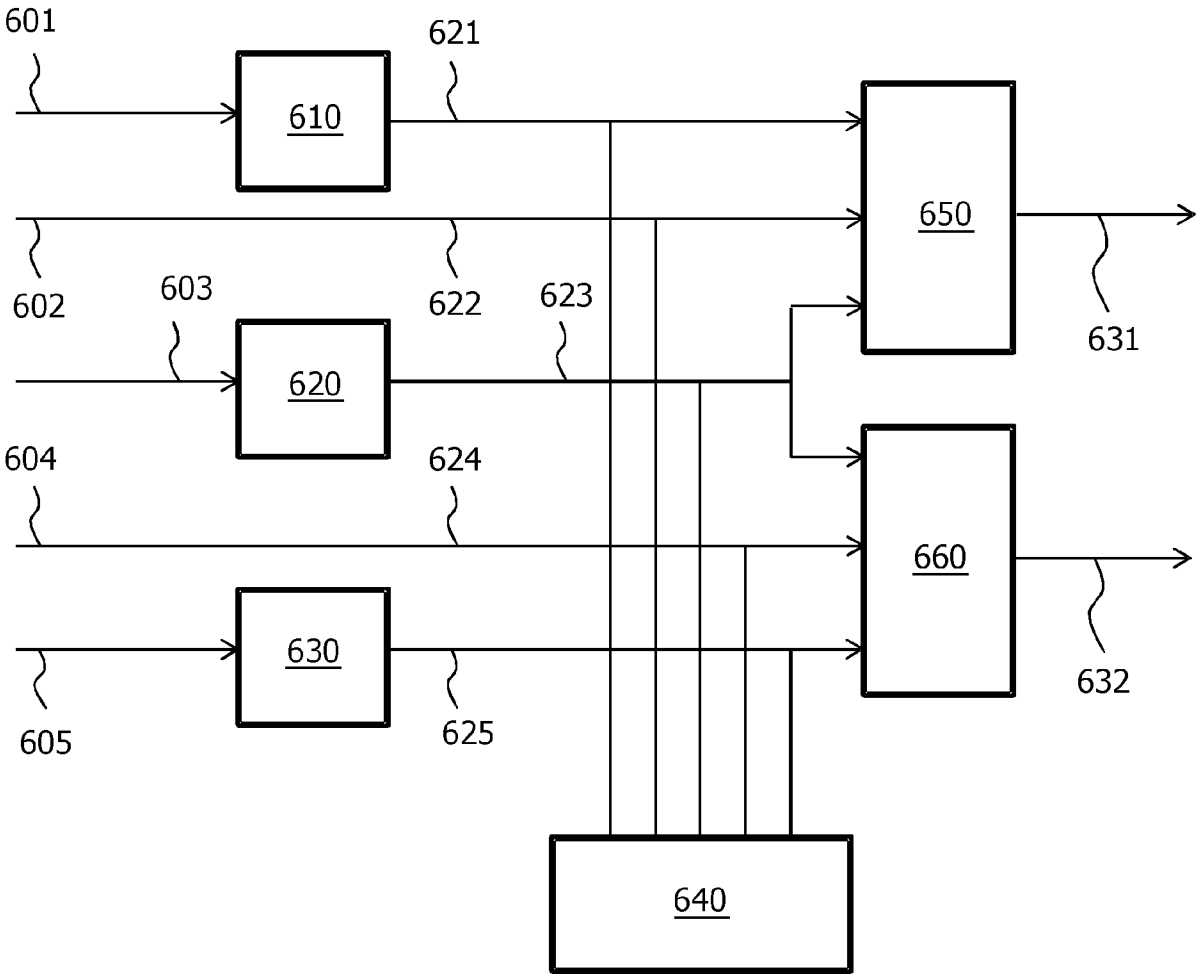
FIG. 5 shows an example of an architecture of a MPEG Surround encoder.

Due to dependence of $T_{umx}$ matrix on the MPEG Surround parameters, the parameters 102 are also fed into the circuit 410. The resulting intermediate signals are fed into a gain compensation circuit 420, in which each of the intermediate signals is scaled with a respective gain to compensate the unequal weighting of the component signals comprised in the input signal. The circuit 420 implements a matrix multiplication of a vector comprising the three intermediate signals with a gain compensation matrix:

$$G = \begin{bmatrix} G_l & 0 & 0 \\ 0 & G_r & 0 \\ 0 & 0 & G_c \end{bmatrix},$$

wherein $G_l$ is a gain that corresponds to the left intermediate signal, $G_r$ is a gain that corresponds to the right intermediate signal, and $G_c$ is a gain corresponding to the center intermediate signal. The gains $G_l$ and $G_r$ are employed to compensate for any power loss due to surround gain $g_s$. The gain $G_c$ is employed to compensate for the power increase due to the center gain $g_c$. This gain is independent of the MPEG Surround parameters and equal to $G_c=1/(2\cdot g_c)$. The meaning of the surround gain and the center gain will be explained in more detail when FIG. 5 is discussed, for now it is sufficient to know that $g_s$ is the actual weight that has been used to scale the surround channel signal pertaining to the input signal, and $g_c$ is the actual weight that has been used to scale the center channel signal pertaining to the input signal.

In an embodiment, the respective gain $G_l$, $G_r$, or $G_c$ corresponding to the respective intermediate signal (the left intermediate signal, the right intermediate signal, or the center intermediate signal) is calculated as a weighted sum of predetermined further gains, wherein the predetermined further gains are derived from weights used to create the input signal 101. These predetermined further gains are weighted with respective weights that are derived from relative contributions of the weighted component signals to the respective intermediate signal.

The respective gains $G_l$ and $G_r$ are preferably calculated according to the following general expression:

$$G_l = \frac{1}{g_f} \cdot f(IID_l)^a + \frac{1}{g_s} \cdot (1 - f(IID_l))^a$$

$$G_r = \frac{1}{g_f} \cdot f(IID_r)^a + \frac{1}{g_s} \cdot (1 - f(IID_r))^a,$$

wherein $g_f$ is the actual weight that has been used to scale the front channel signal pertaining to the input signal (typically $g_f=1$, see the description of FIG. 5 for more detail), $g_s$ is the actual weight that has been used to scale the surround channel signal contributing to the input signal, $f(IID_l)$ is a relative contribution of the weighted component signal corresponding to the left front channel to the left intermediate signal, $(1-f(IID_l))$ is a relative contribution of the weighted component signal corresponding to the left surround channel to the left intermediate signal. The index/ stands for "left" and the index r stands for "right" to differentiate between the left channel and the right channel, and a is a parameter denoting the manner in which the weights complement each other (a=0.5 for power complementary weights and a=1 for amplitude complementary weights).

The relative contribution of the weighted component signals to the respective intermediate signal is derived from an intensity difference $IID_l$, or $IID_r$ (where the indices l and r stand for "left channel" and "right channel" respectively), between the weighted component signals contributing to the intermediate signal, wherein the intensity difference is derived from the parameters 102. These relative contributions are indicated by use of function $f$ and $(1-f)$. $IID_l$ is the logarithmic inter-channel intensity difference (IID) between the weighted left front channel and the weighted left surround channel, and $IID_r$ is logarithmic inter-channel intensity difference (IID) between the weighted right front channel and the weighted right surround channel. An example of f(IID) is:

$$f(IID) = \frac{10^{\frac{IID}{10}}}{1 + 10^{\frac{IID}{10}}}.$$

Other functions are also possible, they should however map the logarithmic IID values to weights with the values between 0 and 1.

The scaled intermediate signals 421, 422, and 423 are fed into the circuit 430, which is the Three-To-Two (inverse-TTT) encoder module known from the MPEG Surround. The circuit 430 downmixes the three scaled intermediate signals into the signal 103 which subsequently is fed into the send effect processing circuit 110. For $T_{dmx}$, being the matrix representing the inverse-TTT module, the downmixing is implemented as matrix multiplication by:

$$T_{dmx} = \begin{bmatrix} 1 & 0 & \frac{1}{\sqrt{2}} \\ 0 & 1 & \frac{1}{\sqrt{2}} \end{bmatrix}.$$

Although the downmixing indicated above results in the stereo signal 103, the downmixing could also provide a mono signal.

For the example depicted in FIG. 4 the signals 103*a* and 103*b* can be expressed as the result of the following matrix multiplication:

$$T_{dmx} \cdot G \cdot T_{umx} \cdot \begin{bmatrix} l_{dmx} \\ r_{dmx} \end{bmatrix}.$$

Although circuits 410, 420, and 430 are depicted as separate circuits in FIG. 4, the actual hardware or software implementation does not require this strict circuit partitioning. The processing performed in these circuits can be combined for efficiency reasons. Furthermore, the matrix multiplication can be performed on a processor, without making the intermediate signals explicitly visible.

The circuit 110 depicts the send effect processing circuit, which comprises circuits 530, 520, and 510. In the circuit 530 the downmixing of the stereo signal 103, which resulted from adapting the input signal 101, is done resulting in a mono downmix 501. This downmix 501 is fed in parallel to the circuits 520 and 510 which create the reverberation output signal 121 from the downmix signal 501. For reverberation send effect the processing used in the circuits 510 and 520 can be as described in William G. Gardner, "Reverberation Algorithms" in "Applications of Digital Signal Processing to Audio and Acoustics". Mark Kahrs and Karlheinz Brandenburg (Editors), Kluwer, March 1998, or Shreyas A. Paranjpe, Time-variant Orthogonal Matrix Feedback Delay Network Reverberator, Audio Engineering Society 110th Convention Paper 5381, Amsterdam, The Netherlands, 12-15 May 2001. Other send effect processing is described in DAFX: Digital Audio Effects, Udo Zolzer, Xavier Amatriain, Daniel Arfib, Jordi Bonada, Giovanni De Poli, Pierre Dutilleux, Gianpaolo Evangelista, Florian Keiler, Alex Loscos, Davide Rocchesso, Mark Sandler, Xavier Serra, Todor Todoroff, Contributor Udo Zolzer, Xavier Amatriain, Daniel Arfib, John Wiley and Sons, 2002.

Although the number of the intermediate signals is three, the number of intermediate signals is not restricted to three only and it could take any other value. However, the number of intermediate signals should preferably not exceed the number of the component signals. For MPEG Surround when the input signal is mono the preferable number of intermediate signals takes the following values: two, three, or five, which relates to specific configurations favoured by MPEG Surround.

FIG. 5 shows an example of an architecture of a stereo compatible MPEG Surround encoder, and it illustrates how the input signal 101 is created. The signals 601 till 605 are respectively, the surround left channel, the front left channel, the central channel, the front right channel, and the surround right channel. These signals correspond to the component signals from which the input signal 101 is created. The circuits 610, 620, and 630 implement scaling with gains. The circuit 610 scales the signal 601 with the gain $g_s$. The circuit 620 scales the signal 603 with the gain $g_c$. The circuit 630 scales the signal 605 with the gain $g_s$. The remaining signals 602 and 604 are also scaled, however since the gain used for scaling them typically takes on value 1, the circuits implementing this scaling is omitted in the figure (for this reason the signal 602 is also referred to as 622, as well as the signal 604 is also referred to as 624). The parameters 102 are derived from the weighted signals 601 till 605 in the parameter extraction circuit 640. The left signal 631 and the right signal 632 are obtained from additions performed in the summation circuits 650 and 660. The signals 621 and 622 related to the left channel are added up with the signal 623 related to the center channel in the circuit 650. Similarly, the signals 625 and 624 related to the right channel are added up with the signal 623 related to the center channel in the circuit 660. The signals 631 and 632 are subsequently encoded. The stereo input signal 101 represents signals 631 and 632 after decoding.

Figure 6:
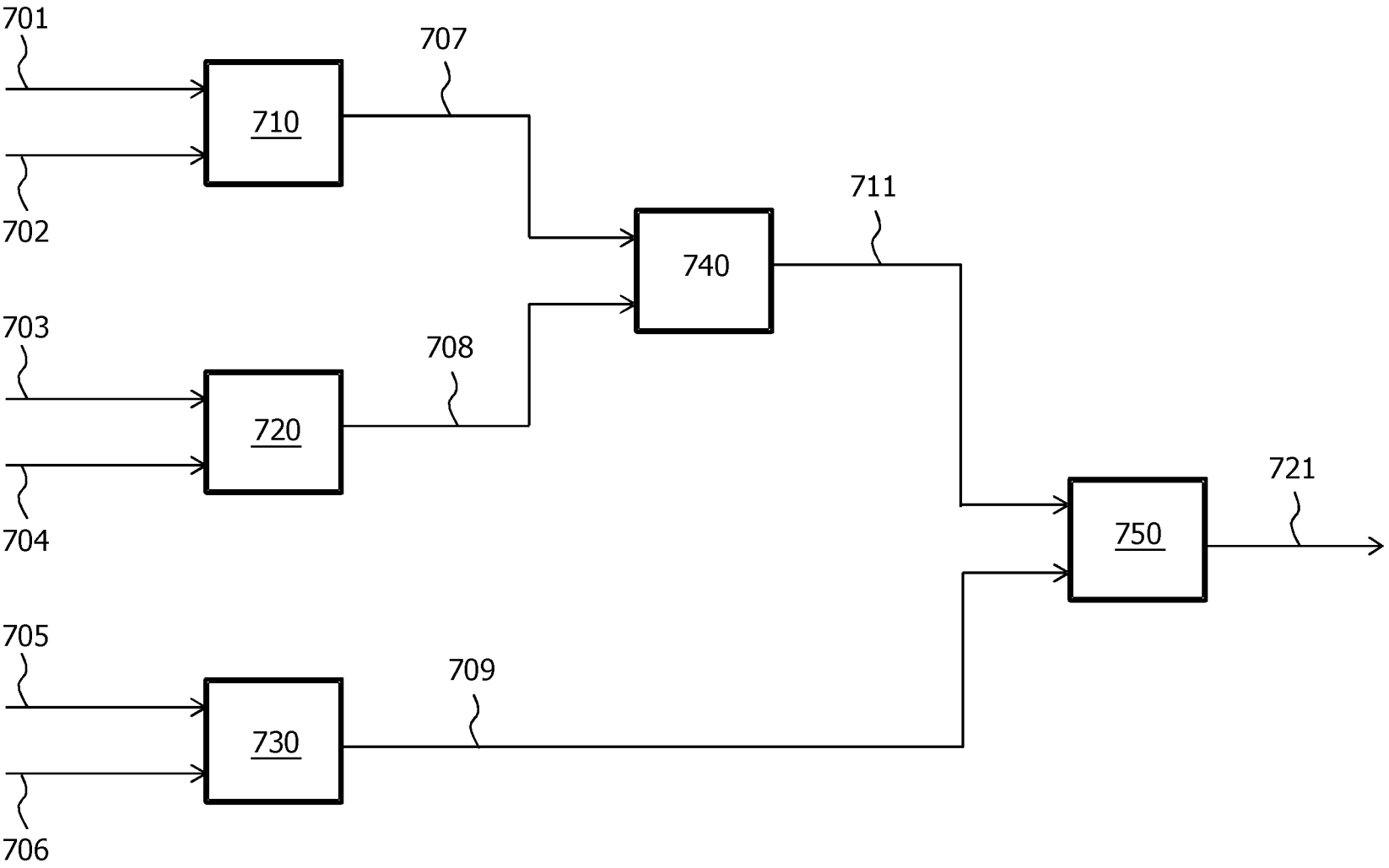
FIG. 6 shows an example of an architecture of MPEG Surround downmixing in 515 configuration.

The input signal 101 can also be a mono signal. FIG. 6 shows an example of an architecture of MPEG Surround downmixing in 515 configuration, which creates a mono input signal. Circuits 710, 720, 730, 740, and 750 are the inverse-One-To-Two modules which downmix two signals into one signal. Such a mono input signal can be adapted to compensate the unequal weighting by scaling with a gain g that is expressed as:

$$g=g_1\cdot c_{0,1}\cdot c_{1,1}\cdot c_{3,1}+g_2\cdot c_{0,1}\cdot c_{1,1}\cdot c_{3,2}+g_3\cdot c_{0,1}\cdot c_{1,2}\cdot c_{4,1}+g_4\cdot c_{0,1}\cdot c_{1,2}\cdot C_{4,2}+g_5\cdot c_{0,2}\cdot c_{2,1}+g_6\cdot c_{0,2}\cdot c_{2,2}$$

where $c_{i,j}$ is defined by the IID of One-To-Two (OTT) box i as follows:

$$c_{i,j}=\begin{cases}\sqrt{\dfrac{10^{\frac{IID_i}{10}}}{1+10^{\frac{IID_i}{10}}}} & \text{for } j=1,\\ \sqrt{\dfrac{1}{1+10^{\frac{IID_i}{10}}}} & \text{for } j=2,,\end{cases}$$

wherein the index i takes on values from 0 to 4 where index with a value 0 relates to the circuit 750, 1 to the circuit 740, 2 to the circuit 730, 3 to the circuit 710, and 4 to the circuit 720. Index j takes on values 1 or 2 and indicates the output channel of the corresponding OTT box i in the MPEG Surround decoder configuration (inverse of FIG. 6). The expression for $c_{i,j}$ uses a specific type of function $f$(IID), however other types are also possible. The above configuration is one of the possible configurations prescribed by the MPEG Surround. Other configurations are also possible, however the expression for the gain g should be adapted to the configuration used. Table 1 shows the gain values for $g_1$ till $g_6$, which are derived from weights used to create the input signal 101.

TABLE I

Channel ordering for the two MPEG Surround 515 configurations with corresponding alignment gains.

| | 5151 configuration | | 5152 configuration | |
|---|---|---|---|---|
| Input signal | Channel ID | gain | Channel ID | gain |
| Signal 701 | $L_f$ | $g_1 = 1$ | $L_f$ | $g_1 = 1$ |
| Signal 702 | $R_f$ | $g_2 = 1$ | $L_s$ | $g_2 = 1/g_s$ |
| Signal 703 | C | $g_3 = 1$ | $R_f$ | $g_3 = 1$ |
| Signal 704 | LFE | $g_4 = 1$ | $R_s$ | $g_4 = 1/g_s$ |
| Signal 705 | $L_s$ | $g_5 = 1/g_s$ | C | $g_5 = 1$ |
| Signal 706 | $R_s$ | $g_6 = 1/g_s$ | LFE | $g_6 = 1$ |

In a further embodiment, the input signal 101 is scaled with a gain 120 calculated as a weighted sum of further gains, wherein the further gains are derived from the parameters 102 corresponding to the weighted component signals, wherein the further gains are weighted with weights that are derived from relative contributions of the weighted component signals or combinations of the weighted component signals to the input signal. The relative contribution of the weighted component signals or the combinations of the weighted component signals are derived from intensity differences between weighted component signals contributing to the input signal, wherein the intensity differences are derived from the parameters 102. As indicated above the signals 103*a* and 103*b* can thus be expressed as the result of the following matrix multiplication:

$$T_{dmx} \cdot G \cdot T_{umx} \cdot \begin{bmatrix} l_{dmx} \\ r_{dmx} \end{bmatrix}, \text{ which can be expressed as:}$$

$$[g_1 \ g_2] \cdot \begin{bmatrix} l_{dmx} \\ r_{dmx} \end{bmatrix},$$

wherein the gains $g_1$ and $g_2$ are referred to as further gains.

Figure 7:
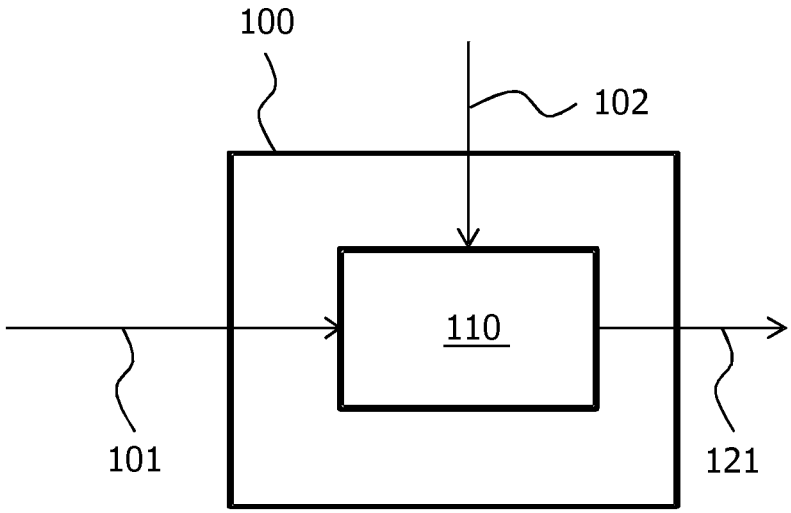
FIG. 7 shows an embodiment of a send effect device comprising adapting send effect processing applied to the input signal.
Figure 8:
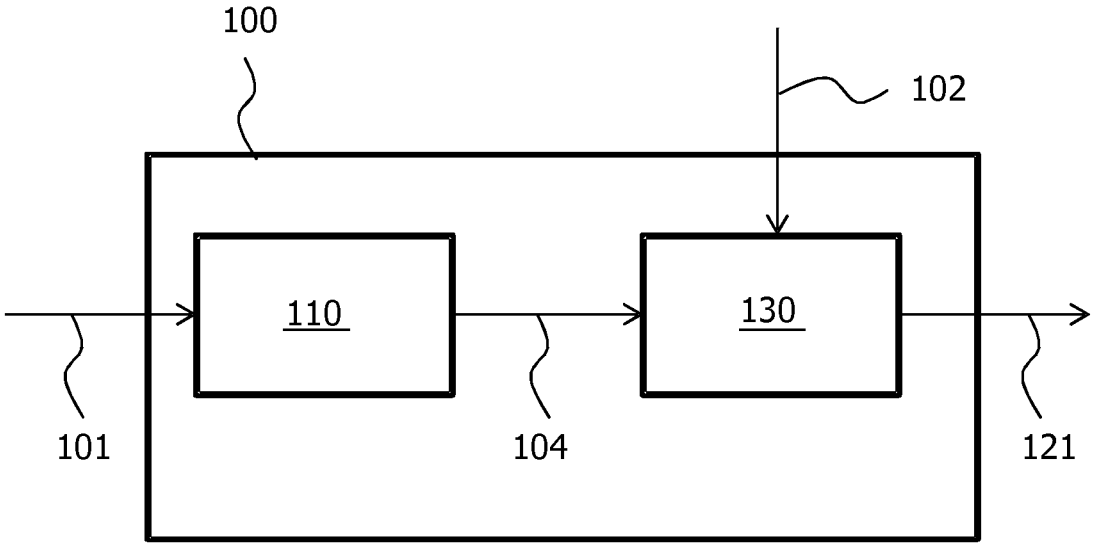
FIG. 8 shows an embodiment of a send effect device comprising adapting an output signal itself in dependence of parameters.

FIG. 7 shows an embodiment of a send effect device comprising adapting send effect processing applied to the input signal 101, and FIG. 8 shows an embodiment of a send effect device comprising adapting an output signal itself in dependence of parameters. These two embodiments show that the adaptation of the input signal 101 can be realized at the different stages, also during the send effect processing or as a post-processing following the send effect processing. In the first case the send effect processing circuit 110 of FIG. 7 has an additional input to which the parameters 102 are provided. The send effect processing itself is adapted to include the adapting of the input signal 101 e.g. by means of scaling. In the second case the output adaptation circuit 130 is fed with a signal resulting from applying the send effect to the input signal 101 in the send effect processing circuit 110. The output adaptation circuit 130 has as an input also the parameters 102. It should be clear for a person skilled in art how the send effect processing circuit 110 should be adapted or what the output adaptation circuit should do.

For the embodiment of FIG. 8 the adapting send effect processing might be realized by applying the gain $g_m$ expressed as:

$$g_m = g_1 \cdot f(IID_{lr})^a + g_2 \cdot (1 - f(IID_{lr}))^a,$$

to both outputs of circuits 510 and 520, which perform the send effect processing. The gains may be delayed and/or adjusted to incorporate e.g. time-spreading effect which is relevant for the reverberation effect. In such a case the gains $g_m'$ are modified such that:

$$\begin{bmatrix} l'_{rev} \\ r'_{rev} \end{bmatrix} = [g'_m \ g'_m] \cdot \begin{bmatrix} l_{rev} \\ r_{rev} \end{bmatrix},$$

where for example $$g_m' = \alpha \cdot g_m[n] + (1-\alpha) \cdot g_m[n-1],$$

with $\alpha$ a coefficient that weighs the gains of the current frame (n) and the previous frame (n−1) according to the temporal spreading of the signal intensity over subsequent frames by the reverberation.

In a further embodiment, the input signal and the parameters are the downmix signal and the parameters, respectively, in accordance with the MPEG Surround standard. The relation of the input signal to the downmix and the parameters to the spatial parameters of MPEG Surround should be clear based on the description of the figures.

Figure 9:
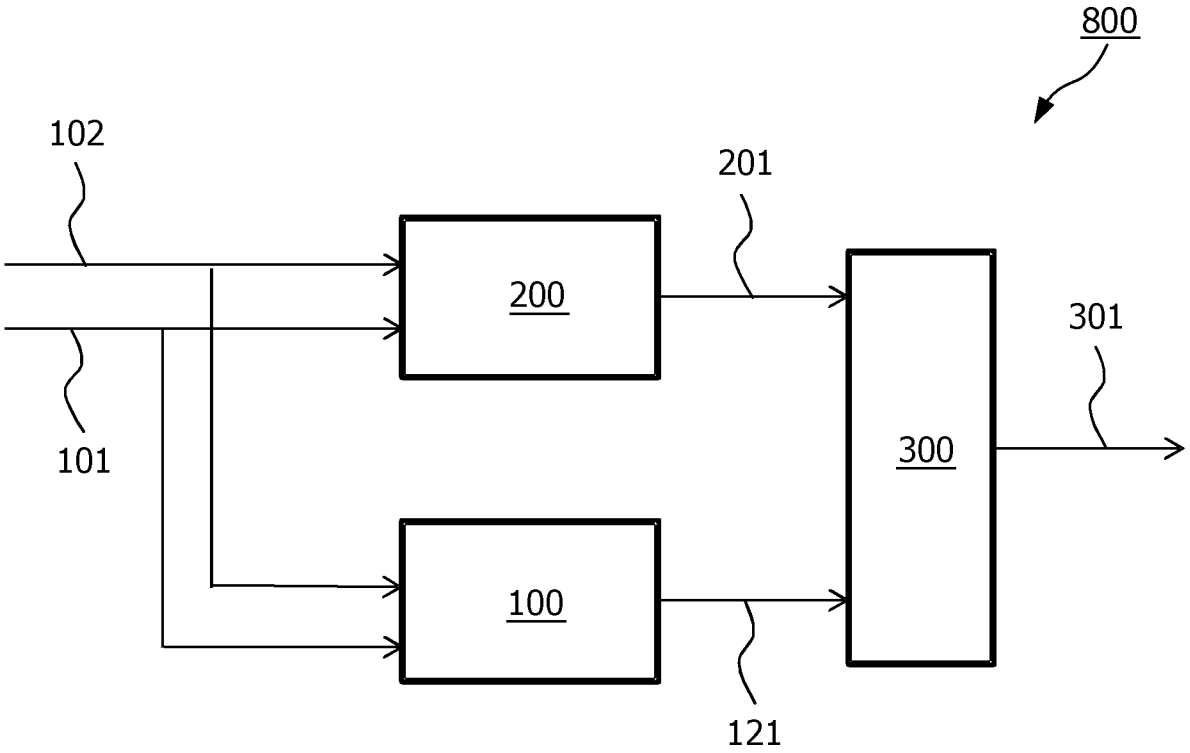
FIG. 9 shows an embodiment of a binaural decoder comprising a binaural renderer in parallel with the send effect device.

FIG. 9 shows an embodiment of a binaural decoder comprising a binaural renderer in parallel with the send effect device. This figure differs from FIG. 1 by the send device 100 having additional input for providing the parameters 102.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term comprising does not exclude the presence of other elements or steps.

Furthermore, although individually listed, a plurality of means, elements or method steps may be implemented by e.g. a single unit or processor. Additionally, although individual features may be included in different claims, these may possibly be advantageously combined, and the inclusion in different claims does not imply that a combination of features is not feasible and/or advantageous. Also the inclusion of a feature in one category of claims does not imply a limitation to this category but rather indicates that the feature is equally applicable to other claim categories as appropriate. In addition, singular references do not exclude a plurality. Thus references to "a", "an", "first", "second" etc. do not preclude a plurality. Reference signs in the claims are provided merely as a clarifying example and shall not be construed as limiting the scope of the claims in any way. The invention can be implemented by means of hardware comprising several distinct elements, and by means of a suitably programmed computer or other programmable device.

The invention claimed is:

1. A method of generating an output signal from an input signal in a device by applying a send effect processing, the method comprising acts of:

the device receiving the input signal including a sum of weighted component signals having unequal weights, and receiving independently from the input signal parameters representing dependencies indicating a relative contribution of respective weighted component signals in the input signal; and, generating the output signal based on the received parameters and the received weighted component signals to adaptively compensate for the unequal weights of the weighted component signals in the input signal.

2. The method as claimed in claim 1, further comprising an act of decomposing the input signal into a plurality of intermediate signals scaled with a respective gain to adaptively compensate for the unequal weights of the weighted component signals.

3. The method as claimed in claim 2, further comprising acts of:

calculating the gain corresponding to the respective intermediate signals as a weighted sum of further gains derived from the unequal weights used to create the input signal; and weighing the further gains with respective second weights that are derived from relative contributions of the weighted component signals to create the respective intermediate signals.

4. The method as claimed in claim 3, further comprising an act of deriving an intensity difference between the weighted component signals from the parameters, and the relative contributions of the weighted component signals to create the respective intermediate signals from the intensity difference.

5. The method as claimed in claim 1, further comprising acts of:

scaling the input signal with a gain calculated as a weighted sum of further gains derived from the parameters corresponding to the weighted component signals;

weighting the further gains with second weights derived from relative contributions of the weighted component signals to the input signal.

6. The method as claimed in claim 5, further comprising an act of:

deriving the relative contributions of the weighted component signals from intensity differences between the weighted component signals contributing to the input signal, the intensity differences are derived from the parameters.

7. The method as claimed in claim 1, further comprising an act of scaling the output signal with a gain that is adjusted in dependence of the parameters.

8. The method as claimed in claim 1, wherein the input signal and the parameters are the downmix signal and the parameters, respectively, in accordance with the MPEG Surround standard.

9. The method of claim 1, wherein the device comprises a processor.

10. The method of claim 9, wherein the device is a binaural decoder.

11. The method of claim 1, wherein the device comprises an adapting circuit for the receiving, a processing circuit for the generating and an adding circuit.

12. The method of claim 11, wherein the adapting circuit and the processing circuit receive the input signal in parallel.

13. The method of claim 11, further comprising acts of the adding circuit adding an output signal to a binaural output signal; and obtaining an improved binaural output signal.

14. The method of claim 1, wherein the input signal comprises left and right channel information and further comprising acts of:

decomposing the input signal into a plurality of intermediate signals, each of the intermediate signals being scaled with a respective gain; and performing upmixing of the input signal into three intermediate signals corresponding to a left channel, a right channel, and a center channel.

15. The method of claim 14, wherein the upmixing is performed in a Two-To-Three (TTT) module.

16. A device for generating an output signal from an input signal by applying a send effect processing, the device comprising:

an adapting circuit configured to receive the input signal including a sum of weighted component signals having unequal weights, and configured to receive independent from the input signal parameters representing dependencies indicating a relative contribution of respective weighted component signals; and a processing circuit configured to generate the output signal based on the received parameters and the received weighted component signals to adaptively compensate for the unequal weights of the weighted component signals comprised in the input signal.

17. A binaural decoder for generating an improved binaural output signal, the binaural decoder comprising:

a binaural renderer configured to receive receiving the input signal including a sum of weighted component signals having unequal weights, and configured to receive independent from the input signal parameters representing dependencies indicating a relative contribution of respective weighted component signals;

configured to decode the input signal into a binaural output signal;

a device configured to generate an output signal based on the received parameters and the received weighted component signals to adaptively compensate for the unequal weights of the weighted component signals in the input signal; and an adding circuit for adding the output signal to the binaural output signal to obtain the improved binaural output signal.

18. The binaural decoder of claim 17, wherein the binaural renderer is an MPEG Surround binaural decoder.

19. A non-transitory computer program product comprising computer instructions, which when executed on a programmable device perform a method of generating an output signal from an input signal by applying a send effect processing, the method comprising acts of:

receiving the input signal including a sum of weighted component signals having unequal weights and receiving independently from the input signal parameters representing dependencies indicating a relative contribution of respective weighted component signals; and generating the output signal based on the received parameters and the received weighted component signals to adaptively compensate for the unequal weights of the weighted component signals in the input signal.

* * * * *